US008002053B2

(12) United States Patent
Ricks et al.

(10) Patent No.: US 8,002,053 B2
(45) Date of Patent: Aug. 23, 2011

(54) SYSTEM, METHOD, AND APPARATUS FOR PREDICTING TRACKING BY ROLLER CONE BITS AND ANTI-TRACKING CUTTING ELEMENT SPACING

(75) Inventors: Greg Ricks, Spring, TX (US); Leroy William Ledgerwood, III, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 111 days.

(21) Appl. No.: 12/191,442

(22) Filed: Aug. 14, 2008

(65) Prior Publication Data

US 2009/0044985 A1 Feb. 19, 2009

Related U.S. Application Data

(60) Provisional application No. 61/005,263, filed on Aug. 17, 2007.

(51) Int. Cl.
*E21B 10/16* (2006.01)

(52) U.S. Cl. ..... 175/374; 175/378

(58) Field of Classification Search ..... 175/374, 175/378, 341

See application file for complete search history.

(56) References Cited

U.S. PATENT DOCUMENTS

| | | | | |
|---|---|---|---|---|
| 1,896,251 | A | 12/1929 | Scott | |
| 4,187,922 | A | 2/1980 | Phelps | |
| 5,311,958 | A | 5/1994 | Isbell et al. | |
| 6,401,839 | B1 * | 6/2002 | Chen | 175/57 |
| 6,516,293 | B1 | 2/2003 | Huang et al. | |
| 6,527,068 | B1 | 3/2003 | Singh et al. | |
| 6,873,947 | B1 | 3/2005 | Huang et al. | |
| 7,195,086 | B2 * | 3/2007 | Aaron et al. | 175/374 |
| 7,234,549 | B2 | 6/2007 | McDonough et al. | |
| 7,647,991 | B2 * | 1/2010 | Felderhoff et al. | 175/341 |
| 7,721,824 | B2 * | 5/2010 | Singh et al. | 175/57 |
| 2005/0167161 | A1 | 8/2005 | Aaron et al. | |
| 2006/0006003 | A1 | 1/2006 | Singh et al. | |

FOREIGN PATENT DOCUMENTS

| | | | |
|---|---|---|---|
| GB | 2403313 | A | 12/2004 |

OTHER PUBLICATIONS

International Search Report PCT/US2008/073247, mailed Dec. 23, 2008. 4 pages.

* cited by examiner

*Primary Examiner* — William P Neuder

(57) ABSTRACT

Embodiments of a system, method, and apparatus for predicting and reducing tracking by roller cone bits by adjusting compact spacing are disclosed. Different pitches between adjacent compacts or teeth provide a cone row that is substantially less likely to track. A given row on a cone may include compacts that are arrayed at a single pitch in a contiguous group for approximately half of the row. The remaining approximately half of the row includes alternating pitches. This configuration enables anti-tracking behavior without very wide spaces and consequent breakage and wear seen in prior art anti-tracking pitch schemes.

15 Claims, 10 Drawing Sheets

SYSTEM, METHOD, AND APPARATUS FOR PREDICTING TRACKING BY ROLLER CONE BITS AND ANTI-TRACKING CUTTING ELEMENT SPACING

This application claims priority to and the benefit of U.S. Provisional Patent Application No. 61/005,263, which was filed on Aug. 17, 2007, and is incorporated herein by reference in its entirety.

BACKGROUND OF THE INVENTION

1. Technical Field

The present invention relates in general to tracking by roller cone drill bits and, in particular, to an improved system, method, and apparatus for predicting and reducing tracking by roller cone bits by adjusting the spacing between the cutting elements.

2. Description of the Related Art

In the prior art, attempts to classify the adverse performance of "tracking" by roller cone bits have focused on either complex simulations of the entire bit or a single row of cutting elements on a single cone of a roller cone bit. For example, U.S. Pat. Nos. 6,516,293, 6,527,068, and 6,873,947, cover modeling and simulating roller cone performance, but require incrementally solving for the motions of individual cones. These complex simulations require substantial computation time and are therefore less useful to a designer during the initial design process.

A second class of simple simulations has traditionally focused on a single row of a single cone and has not acknowledged the effects that other rows of cutting elements on the same cone have on tracking. Additionally, some designs have varied the pitches of cutting elements in different formats, but typically incorporate arrangements of at least some of the cutting elements that may overload the most remote cutting element, which can result in breakage. Thus, solutions for improved tracking performance that overcome these limitations of the prior art would be desirable.

SUMMARY OF THE INVENTION

Embodiments of a system, method, and apparatus for predicting and reducing tracking by roller cone bits by adjusting cutting element spacing are disclosed. Different pitches between adjacent cutting elements (e.g., compacts, teeth, etc.) provide a cone row that is substantially less likely to track. A given row on a cone may include cutting elements that are arrayed at a single pitch in a contiguous group for approximately half of the row. The remaining approximately half of the row includes alternating pitches. This configuration enables anti-tracking behavior without very wide spaces and consequent breakage and wear seen in prior art anti-tracking pitch schemes.

In one embodiment, the invention includes two different angles, pitches A and B, which are substantially different from each other. The row is divided into two groups, each of approximately half the number of cutting elements of the total cutting element quantity. The first group utilizes pitch A, and the second group includes pitches that alternate between pitches A and B. For example, a row with 13 cutting elements may comprise the following pitch sequence: AAAAAAAABABAB or AAAAAABABABAB.

In an alternate embodiment, the sequence may include a third pitch sequence C having a value between those of pitches A and B. Any of the first two pitches may be replaced with the third pitch. In one embodiment, only the final pitch on a row is replaced with the third pitch. For example, in a row having 13 cutting elements, the sequence may comprise AAAAAAAABABAC or AAAAAABABABAC.

Schemes of this nature have several advantages including that they are statistically unlikely to track. After a given tracking event, subsequent contacts are much less likely to track. In addition, compared to traditional, statistically busted pitch arrangements, alternating pitches ensures that no single cutting element is excessively loaded. For example, a pitch scheme of AAAAAAAAAABBB is substantially more likely to have broken cutting elements than a pitch constructed in accordance with the invention. These concepts are equally applicable to tungsten carbide insert bits, milled tooth bits, etc.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Embodiments of a system, method, and apparatus for predicting and reducing tracking by roller cone bits by adjusting cutting element spacing are disclosed. The invention simulates a bottom hole in a formation over a range of cone rotational ratios. Optimization of a bit over a range of cone rotational ratios yields a bit design that is resistant to tracking and which performs at a higher rate of penetration (ROP). The invention restricts or forces the cones in a prescribed motion and interprets the results of the controlled motion rather than predicting the behavior of the individual rows or cones.

Figure 1:
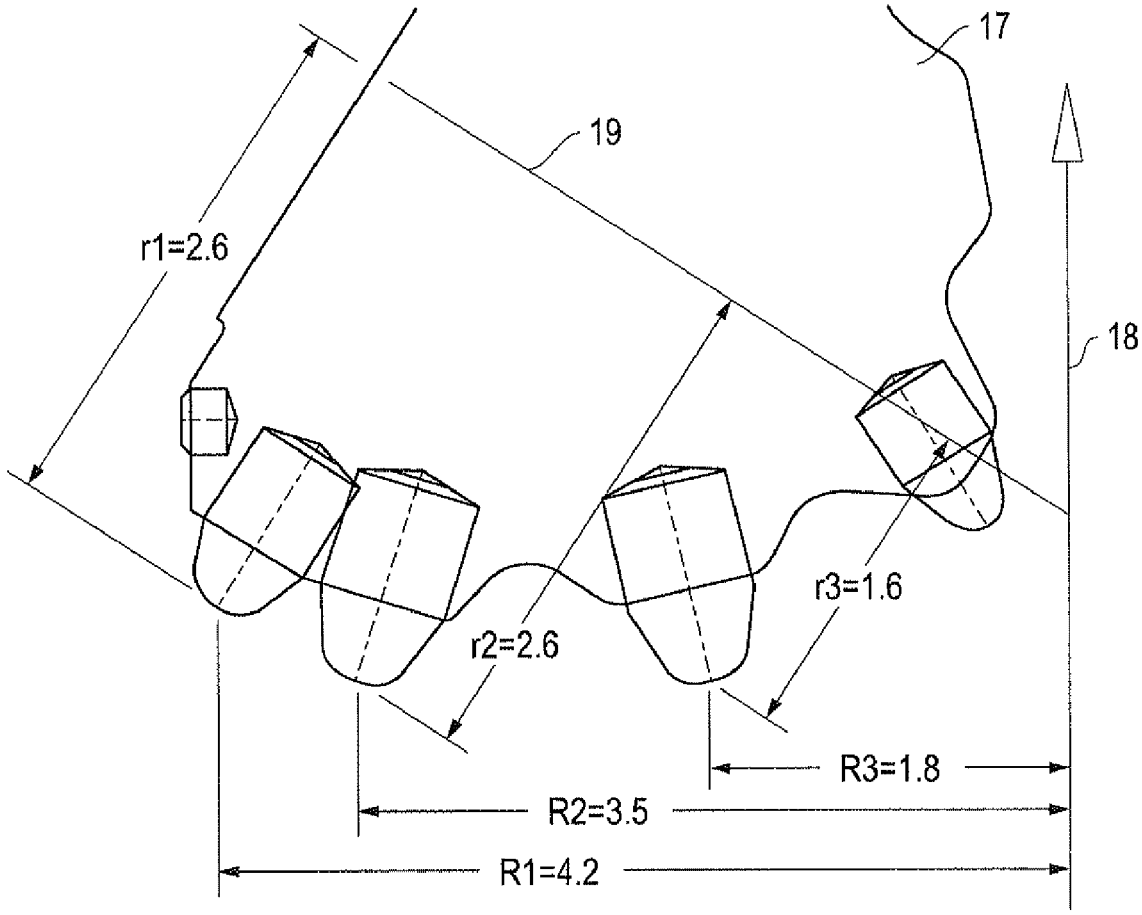
FIG. 1 is a sectional side view of a roller cone illustrating radii from which roll ratios for a roller cone drill bit may be derived.
Figure 12:
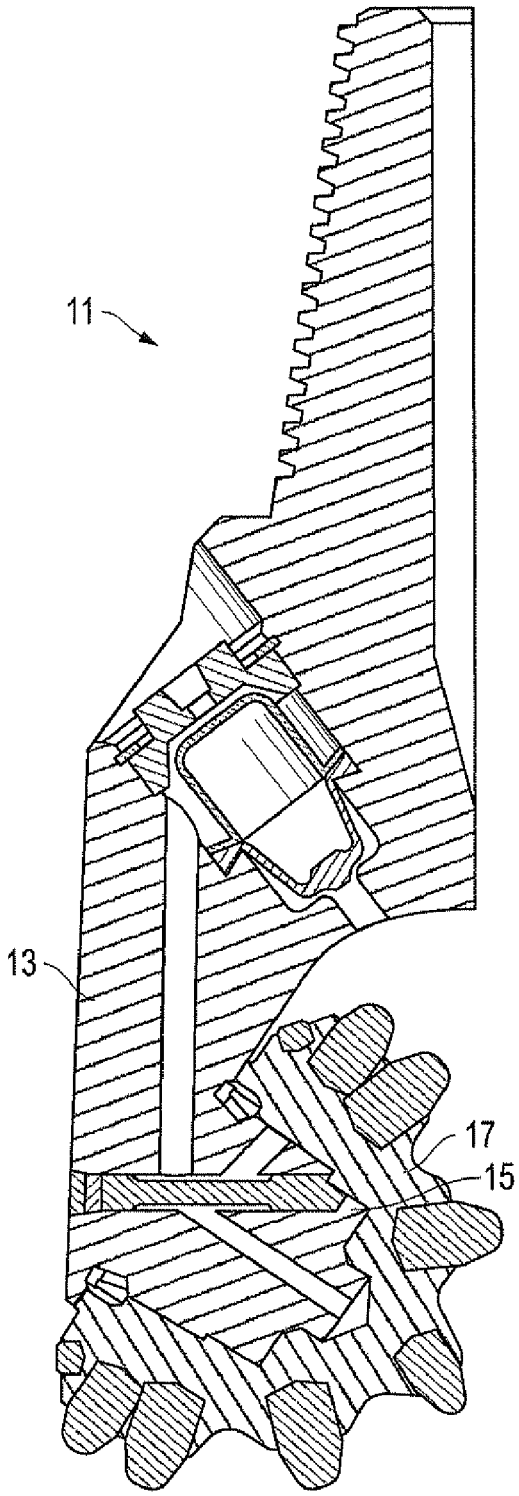
FIG. 12 is an isometric view of one embodiment of an earth boring bit constructed in accordance with the invention.

Referring to FIG. 12, a sectional view of one embodiment of a roller cone bit 11 constructed in accordance with the present invention is shown. Bit 11 comprises a bit body 13 having heads 15 (one shown) with roller cones 17. The roller cones rotate about their respective axes at a speed relative to the speed at which the entire bit is rotating about the drill string axis. The ratio of the cone rotational speed to the bit rotational speed is referred to as a "cone roll ratio" and is generally on the order of 1.3 to 1.5. As shown in FIG. 1, any single row on a cone 17 can have a derived "natural" roll ratio that represents the radius of the row to the bit centerline 18, divided by the radius of the row to the cone centerline 19. This natural roll ratio has an effect on the rate at which a cone rotates but does not control it. For example, in FIG. 1 a first row has a roll ratio of R1/r1=1.62. Similarly, a second row has a row ratio of R2/r2=1.35, and a third row has a roll ratio of R3/r3=1.125. It is expected that this cone will rotate in this range of roll ratios, but will instantaneously vary.

Typically, a cone will rotate at different roll ratios during operation depending on a variety of parameters, including bottom hole pattern, spud-in procedures, changes in formation being drilled, and changes in run parameters. In order to reduce tracking, a system is required that is not restricted to a single roll ratio during operation.

A computer modeling technique has been developed to simulate on-bottom cutting action at fixed roll ratios. Each row is allowed to engage the "formation" by a fixed amount. A cross-section of the cutting element at this fixed depth is then projected onto a two-dimensional plane (see, e.g., FIG. 2) that represents the bottom hole. Only the area that has not already been "cut" is included in the statistical calculations. The cones cycle through the rows and cutting elements for a fixed number of revolutions.

Figure 2:
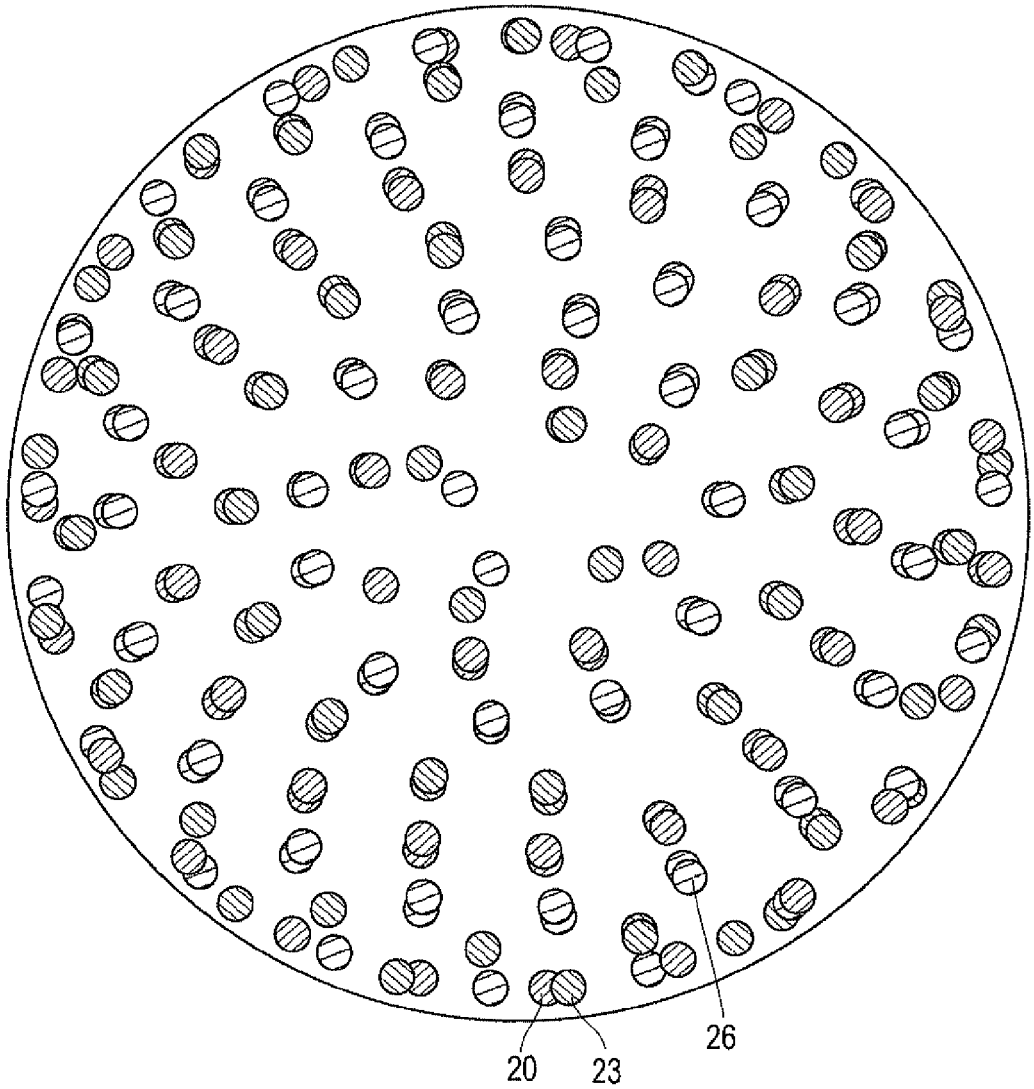
FIGS. 2-4 depict bottom hole patterns for one, two, and three revolutions, respectively, of a drill bit having near perfect cutting efficiency.
Figure 3:
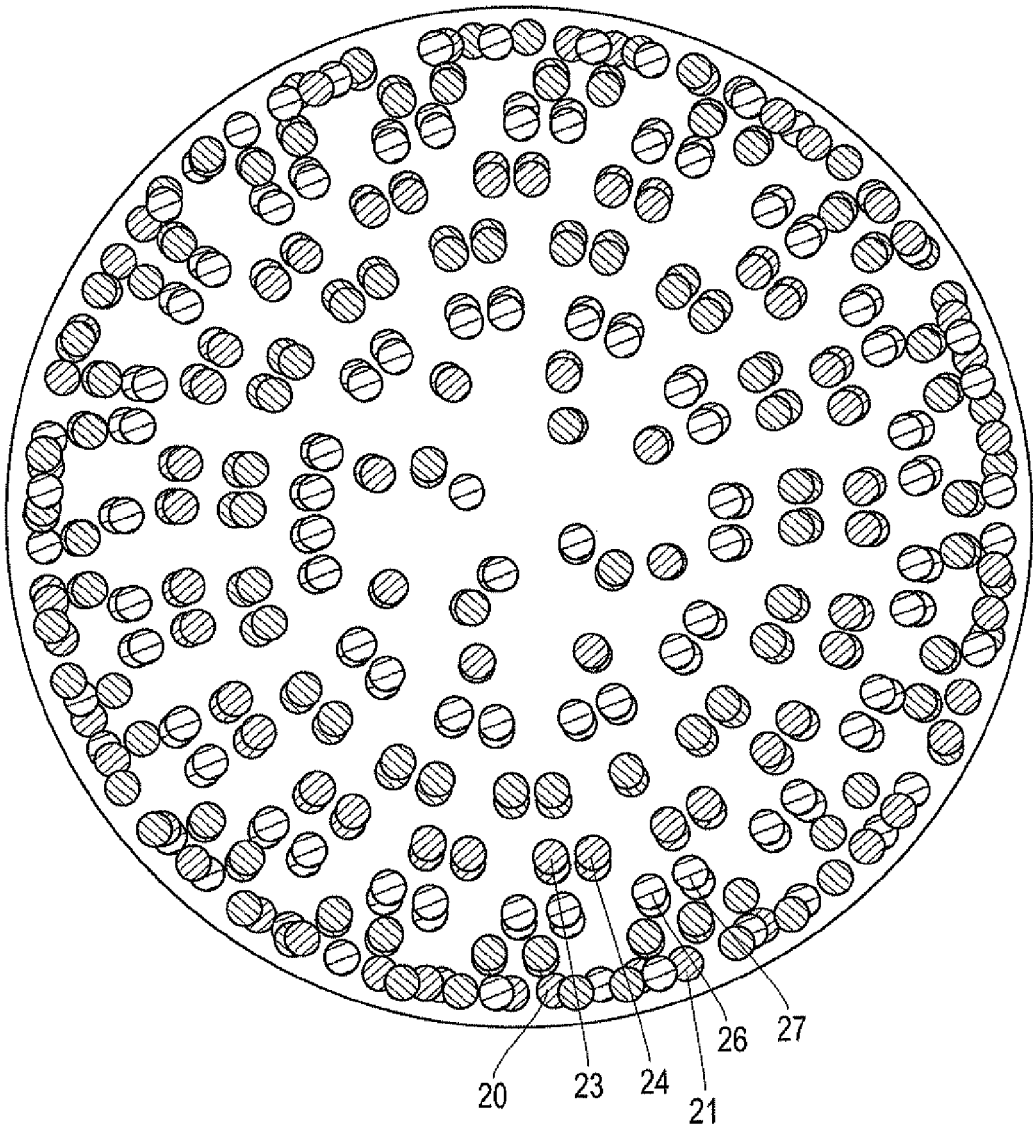
Figure 4:
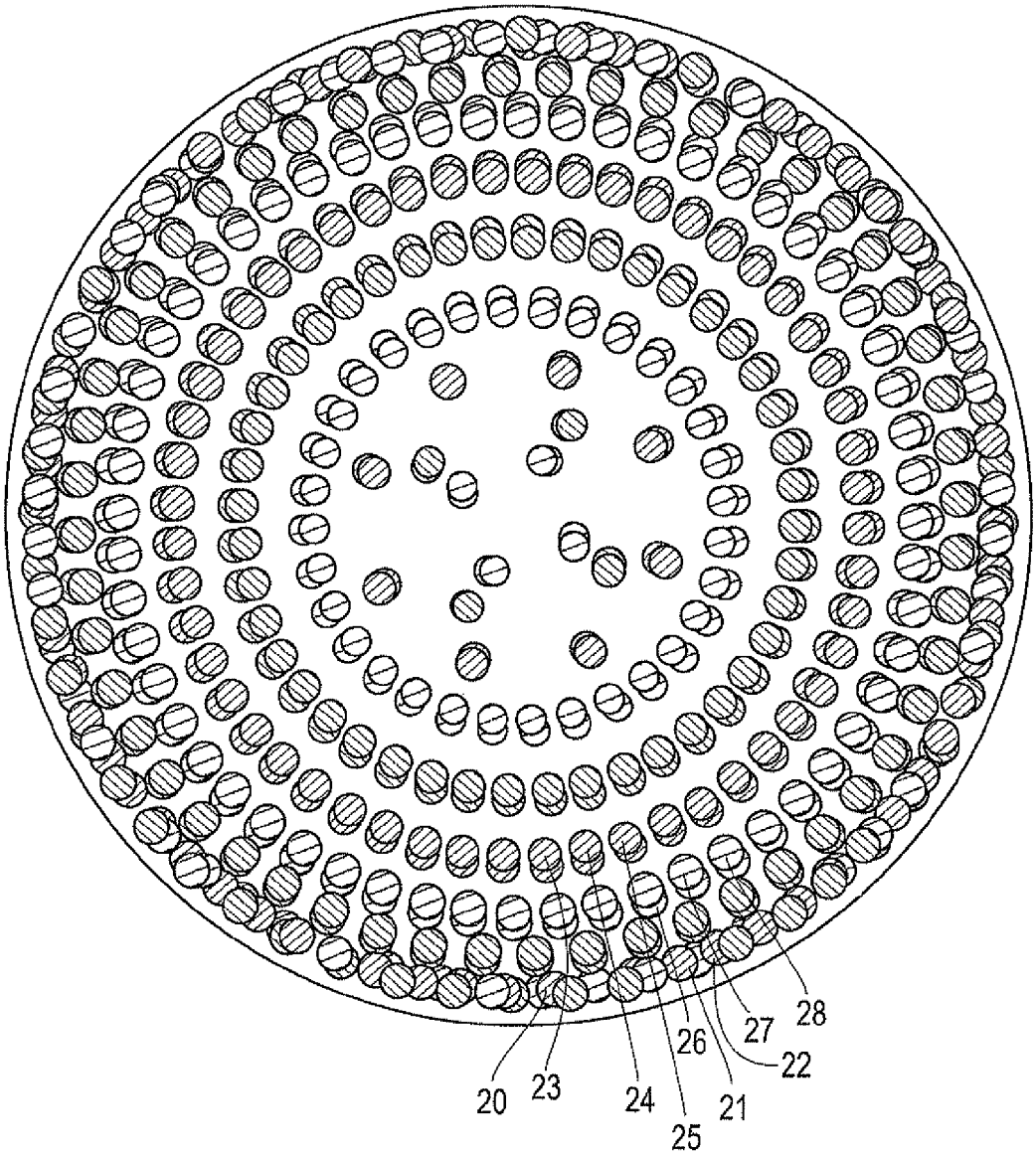

For example, FIG. 2 shows the initial cuts 20, 23, and 26 made by cutting elements on the first, second, and third cones, respectively, after a single revolution of the drill bit. FIG. 3 illustrates the cuts 21, 24, 27 formed by the respective cones after two revolutions of the bit, while FIG. 4 illustrates the cuts 22, 25, 28 formed by the respective cones after three revolutions of the bit. A bit can be simulated over a broad range of roll ratios to better define the performance of the bit in a more general sense.

Figure 5:
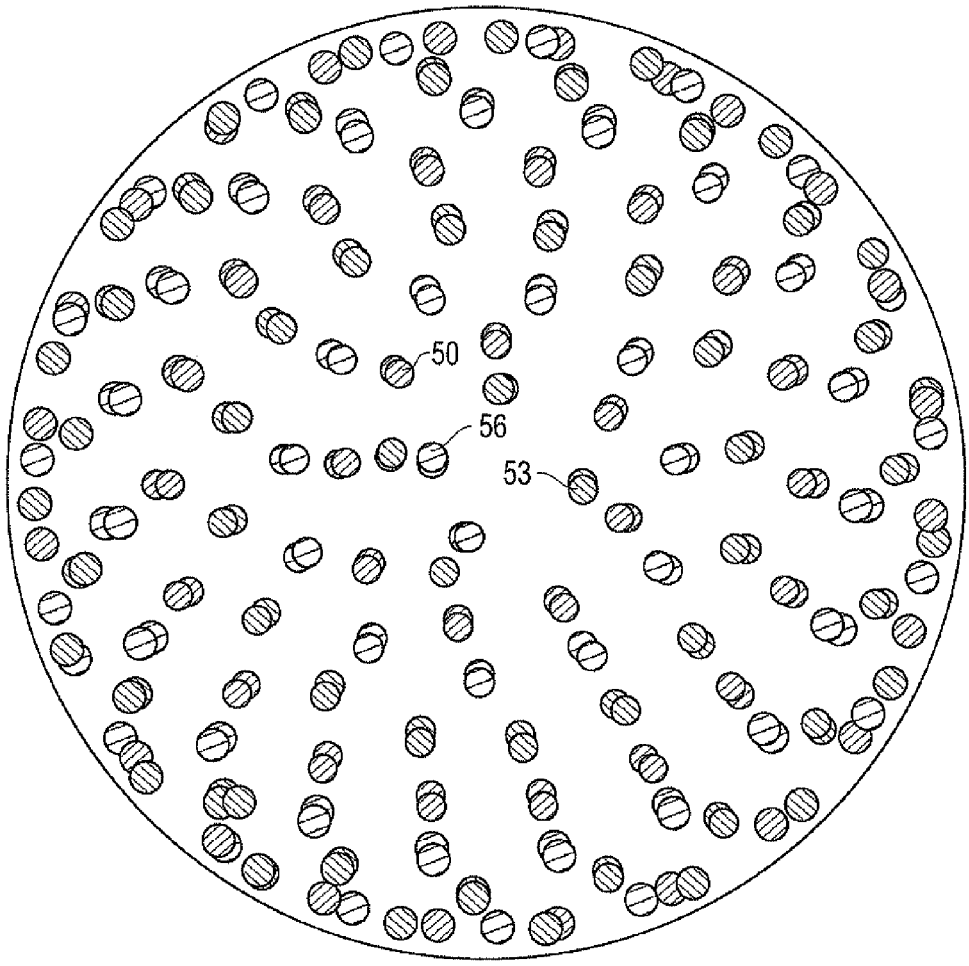
FIGS. 5-7 depict bottom hole patterns for one, two, and three revolutions, respectively, of a drill bit having almost no cutting efficiency.
Figure 6:
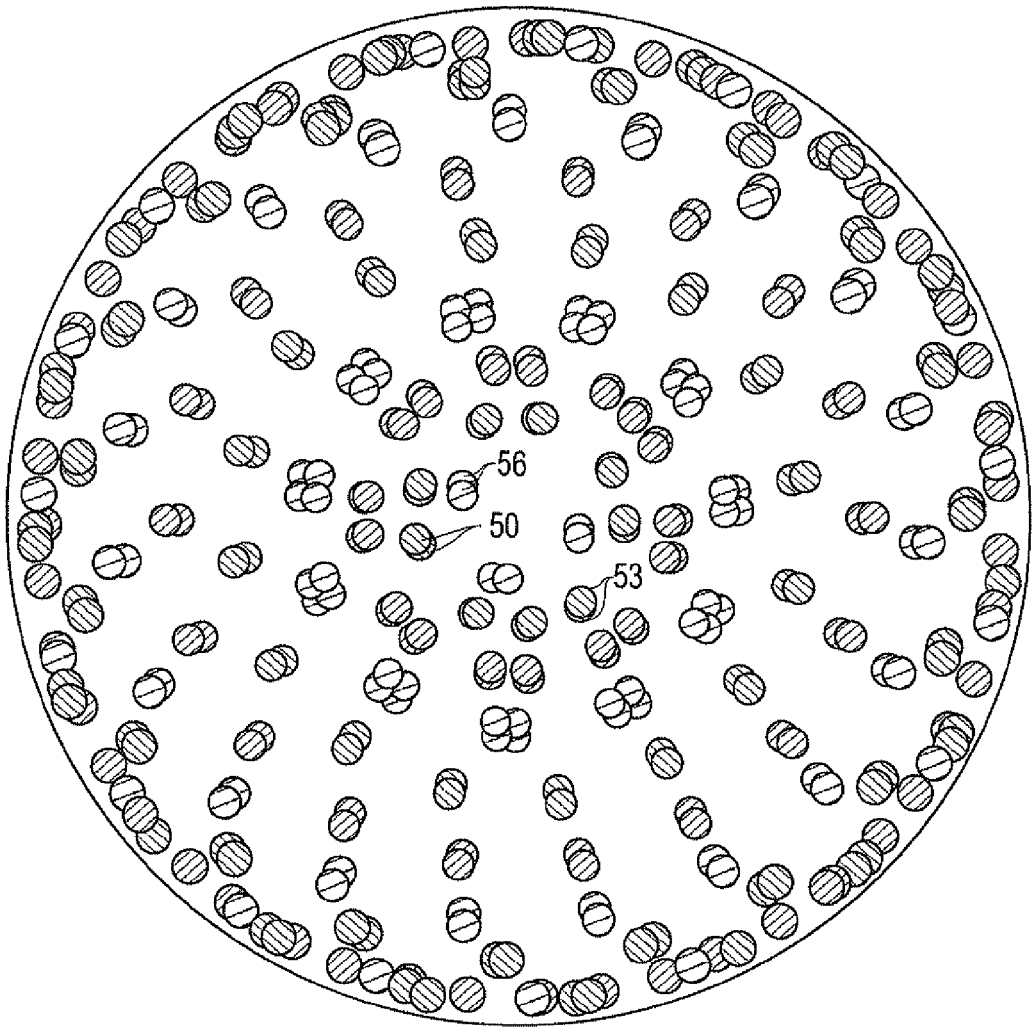
Figure 7:
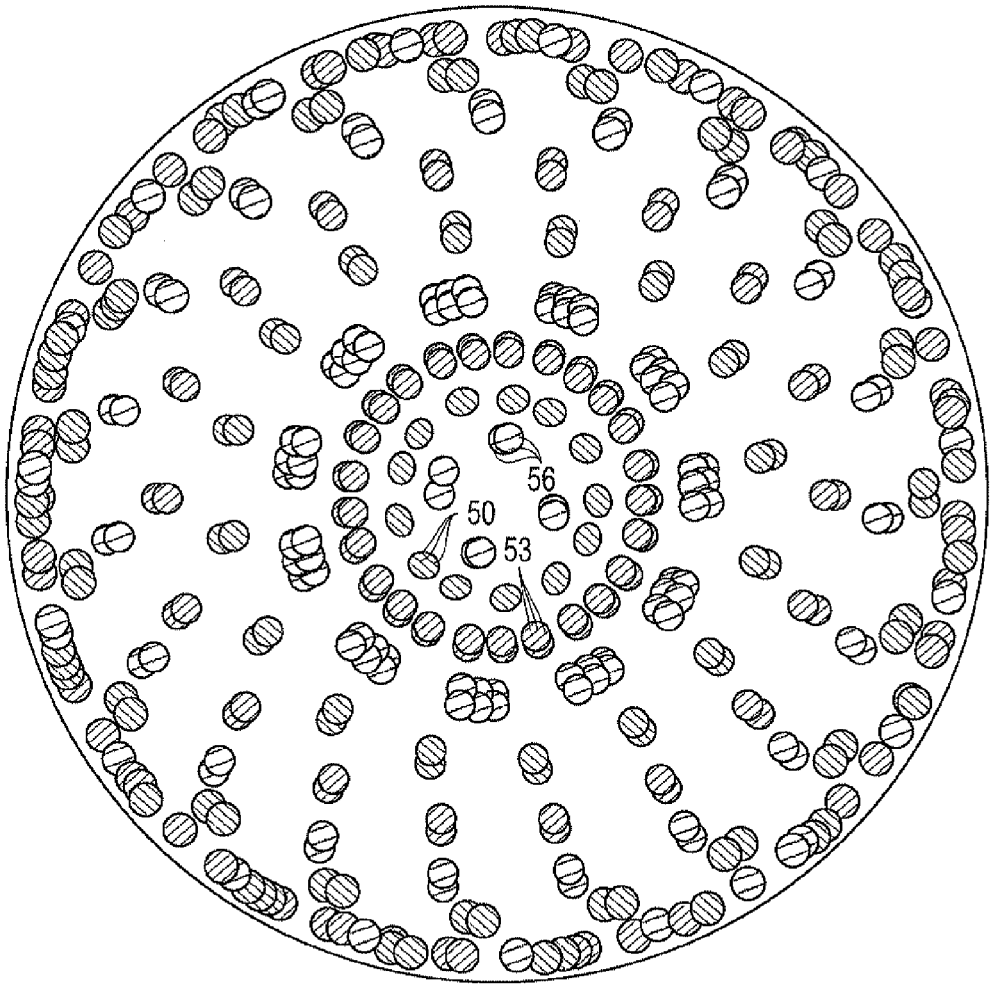

An efficiency of a cone can be determined by evaluating the total area on bottom that the cone removed from the bottom hole compared to the maximum and minimum areas that were theoretically possible. The minimum area is defined as the area that is cut during a single bit revolution at a fixed roll ratio. In order for a cone to cut this minimum amount of material, it must track perfectly into the previous cuts on every subsequent revolution. A cone that removed the minimum area is defined to have zero (0%) efficiency. A drill bit having a very low efficiency is depicted in FIGS. 5-7, which represent one, two, and three revolutions of the bit. The areas 50, 53, 56 cut by the three respective cones over three revolutions vary by only a small amount.

The maximum area is defined as the area that is removed if every cutting element removes the theoretical maximum amount of material. This means that on each revolution, each cutting element does not overlap an area that has been cut by any other cutting element. A cone that removes the maximum material is defined to have 100% efficiency. An example of a drill bit having near perfect efficiency is depicted in FIGS. 2-4, which represent one, two, and three revolutions of the bit, respectively. An alternate means of calculating the maximum area is to evaluate the total area on bottom defined by an inside and outside edge of a cutting element.

Cone efficiency for any given cone is a linear function between these two boundaries. Bits that have cones with high efficiency over a range of roll ratios will drill with less tracking and therefore higher ROP. In one embodiment, the lowest efficiencies for a cone are increased by modifying the spacing arrangement or otherwise moving cutting elements to achieve greater ROP. In another embodiment, the average efficiency of a cone is increased to achieve greater ROP.

This method of evaluating tracking has several advantages. First, it is significantly faster to run a simulation than more computationally intense methods that vary multiple drilling parameters, such as variations in formation and interaction between the bit and the formation. For example, a single bit design may be simulated 200 times through three revolutions in a small fraction of the time required for conventional methods. Each simulation "forces" the cones to rotate at a selected rate, and the process is repeated over a designated range. This time savings is useful to bit designers attempting to qualify a design while it is still relatively easy to change. Second, unlike traditional simulation methods, this design provides a solution that considers the effects that other rows on a cone will have on tracking. Additionally, the overall bottom hole pattern can be displayed to the designer for further insights in the design process.

In some embodiments, a scheme for producing the angles (i.e., pitches) between adjacent cutting elements provides a row that is substantially less likely to track. For example, a given row on a cone may include cutting elements that are arrayed at a single pitch in a contiguous group for approximately half of the row. The remaining approximately half of the row includes alternating pitches. This configuration enables anti-tracking behavior without very wide spaces and consequent breakage and wear seen in prior art anti-tracking pitch schemes.

Figure 8:
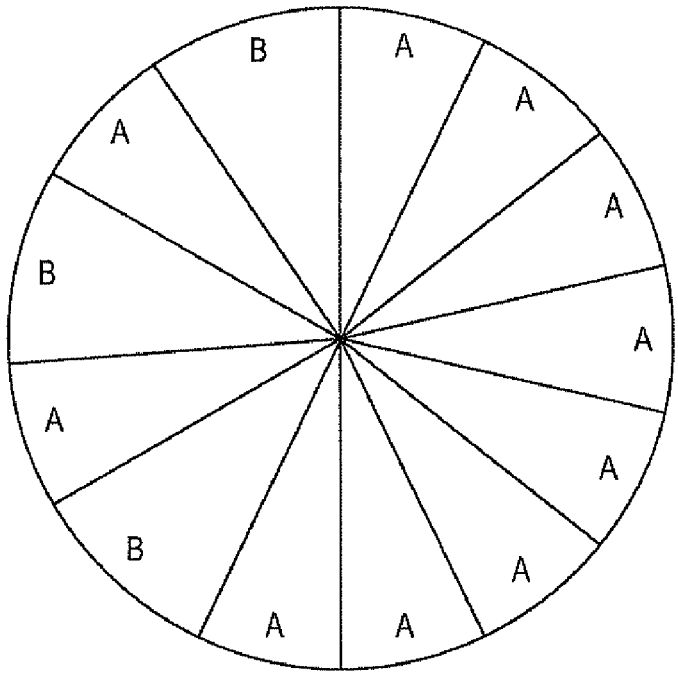
FIGS. 8-11 illustrate several embodiments of multi-pitch rows for roller cone bits.
Figure 9:
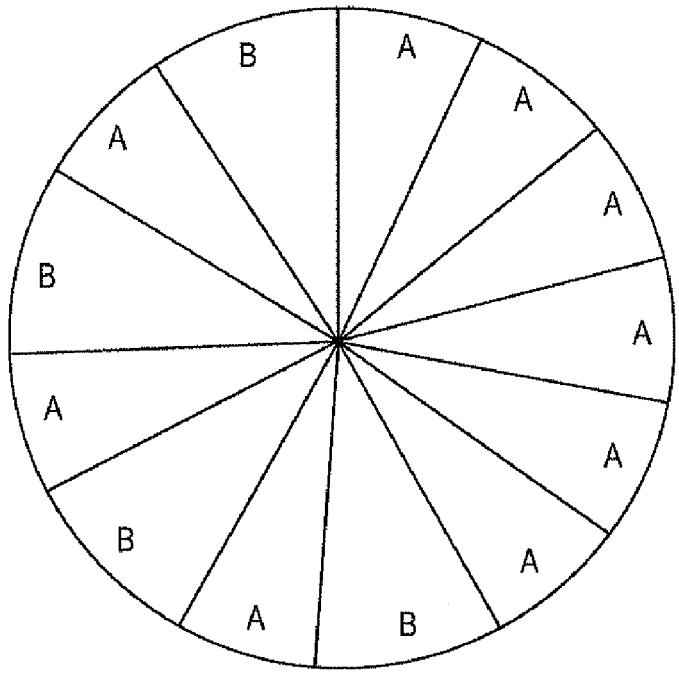

In one embodiment, the invention includes two different angles, pitches A and B, which are substantially different from each other (e.g., in the range of 20% to 40%). The row is divided into two groups, each of approximately half the number of cutting elements (e.g., in the range of 40 to 70%) of the total cutting element quantity. The first group utilizes pitch A, and the second group includes pitches that alternate between pitches A and B. For example, a row with 13 compacts may comprise the following pitch sequence: AAAAAAAABABAB (e.g., FIG. 8), or AAAAAABABABAB (e.g., FIG. 9).

Figure 10:
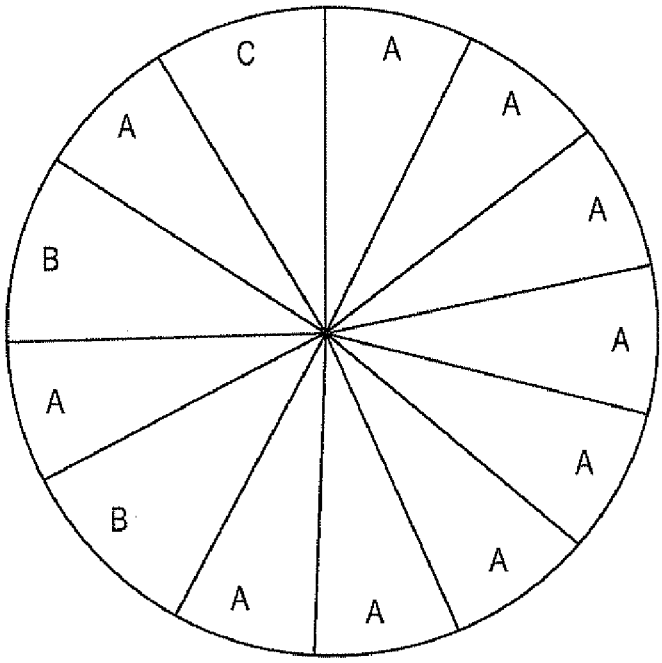
Figure 11:
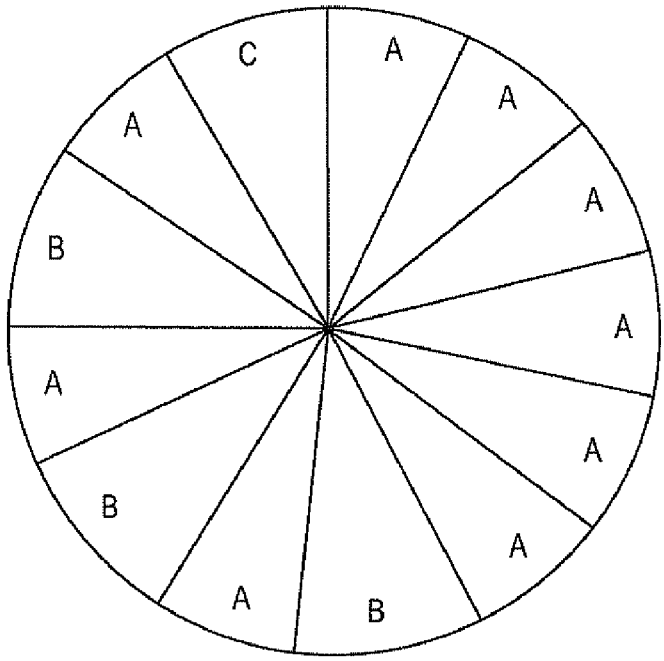

In an alternate embodiment, the sequence may include a third pitch sequence C having a value between those values of pitches A and B (e.g., about 60% towards B from A). Any of the first two pitches may be replaced with the third pitch. In one embodiment, only the final pitch on a row is replaced with the third pitch. For example, in a row having 13 compacts, the sequence may comprise AAAAAAAABABAC (e.g., FIG. 10), or AAAAAABABABAC (e.g., FIG. 11).

Schemes of this nature have several advantages including that they are statistically unlikely to track. After a given tracking event, subsequent contacts are much less likely to track. In addition, compared to traditional, statistically busted pitch arrangements, alternating pitches ensures that no single compact is excessively loaded. For example, a pitch scheme of AAAAAAAAAABBB is substantially more likely to have broken compacts than a pitch constructed in accordance with the invention. These concepts are equally applicable to tungsten carbide insert bits and to milled tooth bits.

In another embodiment, the drill bit comprises a bit body having one or more cantilevered bearing shafts depending from the bit body; a roller cone mounted to each bearing shaft to define a plurality of roller cones, and each roller cone having a plurality of rows of cutting elements; at least one row of cutting elements has at least two pitches between the cutting elements on the at least one row of cutting elements, wherein 20% to 40% of the pitches are larger than a remaining 60% to 80% of the pitches; and the larger pitches are disposed on approximately half of the at least one row of cutting elements with no larger pitches being adjacent to another larger pitch.

The larger pitches may be 20% to 40% larger than the remaining pitches. The at least one row of cutting elements may contain at least three larger pitches. The larger pitches may be disposed on 50% to 60% of the at least one row of cutting elements, or disposed on 30% to 50% of the at least one row of cutting elements. In addition, the at least one row of cutting elements may contain at least nine cutting elements.

In still another embodiment, the invention may comprise a drill bit with a bit body having one or more cantilevered bearing shafts depending from the bit body; a roller cone mounted to each bearing shaft to define a plurality of roller cones, and each roller cone having a plurality of rows of cutting elements; at least one row of cutting elements on at least one of the roller cones has at least nine cutting elements disposed with at least two pitches between the cutting elements on the at least one row of cutting elements, wherein 20% to 40% of the pitches are 20% to 40% larger than a remaining 60% to 80% of the pitches; and the larger pitches are disposed on 30% to 60% of the at least one row of cutting elements with no larger pitches being adjacent to another larger pitch. The at least one row of cutting elements may contain at least three larger pitches.

While the invention has been shown or described in only some of its forms, it should be apparent to those skilled in the art that it is not so limited, but is susceptible to various changes without departing from the scope of the invention.

What is claimed is:

1. A drill bit, comprising;

a bit body having bearing shafts depending therefrom;

a roller cone mounted to each bearing shaft to define a plurality of roller cones, and each roller cone having a plurality of rows of cutting elements; and at least one of the rows of cutting elements on at least one of the roller cones has at least two pitches between adjacent cutting elements, wherein some of the cutting elements are arrayed at a first pitch in a contiguous group for approximately half of the at least one of the rows, and remaining ones of the cutting elements on the at least one of the rows are arrayed in alternating pitches.

2. A drill bit according to claim 1, wherein the alternating pitches differ from each other by 20% to 40%.

3. A drill bit according to claim 1, wherein the at least one of the rows is divided into two groups, each comprising approximately half of the cutting elements, the first pitch being pitch A, and a second group including pitches that alternate between pitches A and B.

4. A drill bit according to claim 3, wherein the approximately half of the cutting elements represent 40% to 70% of a total number of the cutting elements and are arrayed at pitch A.

5. A drill bit according to claim 3, wherein the at least one of the rows contains at least nine cutting elements.

6. A drill bit according to claim 3, wherein the at least one of the rows comprises a third pitch C having a value between those of pitches A and B.

7. A drill bit according to claim 6, wherein the value of pitch C is about 60% towards a value of pitch B from a value of pitch A.

8. A drill bit, comprising:

a bit body having one or more cantilevered bearing shafts depending from the bit body;

a roller cone mounted to each bearing shaft to define a plurality of roller cones, and each roller cone having a plurality of rows of cutting elements;

at least one row of cutting elements has at least two pitches between the cutting elements on the at least one row of cutting elements, wherein 20% to 40% of the pitches are larger than a remaining 60% to 80% of the pitches;

the larger pitches are disposed on approximately half of the at least one row of cutting elements with no larger pitches being adjacent to another larger pitch; and all of the cutting elements on said at least one row are formed at a single cone radius.

9. A drill bit according to claim 8, wherein the larger pitches are 20% to 40% larger than the remaining pitches.

10. A drill bit according to claim 8, wherein the at least one row of cutting elements contains at least three larger pitches.

11. A drill bit according to claim 8, wherein the larger pitches are disposed on 50% to 60% of the at least one row of cutting elements.

12. A drill bit according to claim 8, wherein the larger pitches are disposed on 30% to 50% of the at least one row of cutting elements.

13. A drill bit according to claim 8, wherein the at least one row of cutting elements contains at least nine cutting elements.

14. A drill bit, comprising;

a bit body having one or more cantilevered bearing shafts depending from the bit body;

a roller cone mounted to each bearing shaft to define a plurality of roller cones, and each roller cone having a plurality of rows of cutting elements;

at least one row of cutting elements on at least one of the roller cones has at least nine cutting elements disposed with at least two pitches between the cutting elements on the at least one row of cutting elements, wherein 20% to 40% of the pitches are 20% to 40% larger than a remaining 60% to 80% of the pitches;

the larger pitches are disposed on 30% to 60% of the at least one row of cutting elements with no larger pitches being adjacent to another larger pitch; and all of the cutting elements on said at least one row are formed at a single cone radius.

15. A drill bit according to claim 14, wherein the at least one row of cutting elements contains at least three larger pitches.

* * * * *